US008182203B2

(12) United States Patent
Hada et al.

(10) Patent No.: US 8,182,203 B2
(45) Date of Patent: May 22, 2012

(54) TURBINE BLADE AND GAS TURBINE

(75) Inventors: Satoshi Hada, Hyogo (JP); Taku Ichiryu, Hyogo (JP)

(73) Assignee: Mitsubishi Heavy Industries, Ltd., Tokyo (JP)

( * ) Notice: Subject to any disclaimer, the term of this patent is extended or adjusted under 35 U.S.C. 154(b) by 554 days.

(21) Appl. No.: 12/411,569

(22) Filed: Mar. 26, 2009

(65) Prior Publication Data

US 2010/0247290 A1 Sep. 30, 2010

(51) Int. Cl.
*F01D 5/14* (2006.01)

(52) U.S. Cl. ..... 415/115; 416/90 R; 416/96 A; 416/97 R

(58) Field of Classification Search ..... 415/115; 416/90 R, 96 A, 97 R
See application file for complete search history.

(56) References Cited

U.S. PATENT DOCUMENTS 5,533,864 A * 7/1996 Nomoto et al. ..... 416/96 A
5,711,650 A * 1/1998 Tibbott et al. ..... 415/115
5,752,801 A * 5/1998 Kennedy ..... 415/115

FOREIGN PATENT DOCUMENTS

JP 02-040001 A 2/1990
JP 04-063901 A 2/1992
JP 07-145702 A 6/1995
JP 08-260901 A 10/1996
JP 2001-501703 A 2/2001
JP 2005-069236 A 3/2005

OTHER PUBLICATIONS

International Search Report of PCT/JP2010/051571, date of mailing May 18, 2010.

* cited by examiner

*Primary Examiner* — Wai Sing Louie
(74) *Attorney, Agent, or Firm* — Westerman, Hattori, Daniels & Adrian, LLP

(57) ABSTRACT

A turbine blade and a gas turbine are provided in which the velocity of cooling fluid at the inlet of a pin fin region is improved so that the cooling performance at the trailing edge of the turbine blade can be improved. It includes an airfoil; a supply channel extending through the interior of the airfoil in the span direction, through which cooling fluid flows; a pin fin channel extending from the supply channel along the center line of the airfoil toward the trailing edge of the airfoil and opening at the trailing edge to the exterior of the airfoil; a plurality of gap pin fins projecting from a pair of opposing inner walls that constitute the pin fin channel at a region at the supply channel side of the pin fin channel and forming a gap therebetween extending in the span direction; pin fins connecting the pair of opposing inner walls at a region at the trailing edge side of the pin fin channel; and an insertion portion disposed in the gap to decrease the area of the channel of the cooling fluid at the region at the supply channel side of the pin fin channel.

4 Claims, 5 Drawing Sheets

TURBINE BLADE AND GAS TURBINE

BACKGROUND OF THE INVENTION

1. Field of the Invention

The present invention relates to turbine blades and gas turbines, and in particular, to a turbine blade suited for use as a vane and a blade of a turbine, as well as a gas turbine using the turbine blade.

2. Description of the Related Art

In general, high-temperature working fluid flows through turbine blades used in a gas turbine. Therefore, a technology for cooling the turbine blades with a structure to cool the turbine blades using cooling fluid is known (for example, see Japanese Unexamined Patent Application, Publication No. HEI 04-63901 and Japanese Unexamined Patent Application, Publication No. HEI 08-260901).

Japanese Unexamined Patent Application, Publication No. HEI 08-260901 discloses a technology for performing film cooling in which cooling fluid is blown out from film holes or a shower head film holes and performing pin fin cooling by forming a channel through which cooling fluid passes in the trailing edge of the blade and providing projecting pin fins in the channel.

Japanese Unexamined Patent Application, Publication No. HEI 08-260901 discloses a technology for performing film cooling in which cooling fluid is blown out from film holes or a shower head and performing pin fin cooling by forming a channel through which cooling fluid passes in the trailing edge of the blade and providing projecting pin fins in the channel.

In recent years, to improve the efficiency of gas turbines, increasing the temperature of working fluid flowing into the gas turbines, and to cope therewith, improving the cooling efficiency of turbine blades have been under consideration.

As a method for improving the cooling efficiency in cooling turbine blades, for example, for pin fin cooling, a method for improving the cooling efficiency by increasing the velocity of cooling fluid that passes through a region in which pin fins are provided (hereinafter referred to as a pin fin region) is generally known.

However, one problem with cooling the trailing edges of the blades by pin fin cooling is the difficulty in decreasing the cross-sectional area of a channel through which the cooling fluid flows.

That is, turbine blades are often manufactured by casting, and in such a case, the above-described channel is formed using a ceramic core. As described above, to decrease the cross-sectional area of the channel, it is necessary to decrease the cross-sectional area of the ceramic core. Decreasing the thickness of the ceramic core weakens the strength of the ceramic core. This has a problem of making the ceramic core prone to poor casting due to the breakage thereof etc., thus decreasing the manufacturability of the turbine blades.

As a result, there is also a limitation in decreasing the cross-sectional area of the channel, so that the cooling efficiency at the inlet of the pin fin region cannot be increased, thus decreasing the cooling efficiency in the entire pin fin region.

In particular, there is a problem of insufficient cooling efficiency at the inlet of the pin fin region because the velocity of the cooling fluid cannot be increased at the inlet of the pin fin region although it receives a high heat load from combustion gas.

BRIEF SUMMARY OF THE INVENTION

The present invention is made to solve the above-described problems, and it is an object thereof to provide a turbine blade and a gas turbine in which the velocity of the cooling fluid at the inlet of the pin fin region is improved so that the cooling performance (cooling efficiency) at the trailing edge of the turbine blade can be improved.

To solve the above problems, the present invention provides the following solutions.

The turbine blade of the present invention includes an airfoil; a supply channel extending through the interior of the airfoil in the span direction, through which cooling fluid flows; a pin fin channel extending from the supply channel along the center line of the airfoil toward the trailing edge of the airfoil and opening at the trailing edge to the exterior of the airfoil; a plurality of gap pin fins projecting from a pair of opposing inner walls that constitute the pin fin channel at a region at the supply channel side of the pin fin channel and forming a gap therebetween extending in the span direction; pin fins connecting the pair of opposing inner walls at a region at the trailing edge side of the pin fin channel; and an insertion portion disposed in the gap to decrease the area of the channel of the cooling fluid at the region at the supply channel side of the pin fin channel.

With the turbine blade of the present invention, the insertion portion is disposed in the gap formed between the gap pin fins. Therefore, the cross-sectional area of the channel at the supply channel side of the pin fin channel, through which cooling fluid flows, decreases as compared with a case in which the insertion portion is not disposed, so that the velocity of the cooling fluid at the region at the supply channel side increases.

In the turbine blade of the present invention, it is preferable that the cross-sectional area of the insertion portion decrease from the supply channel toward the trailing edge.

With this structure, for example, when the cross-sectional area of the pin fin channel itself decreases from the supply channel toward the trailing edge, the cross-sectional area of the insertion portion also decreases. This can reduce changes in the cross-sectional area of the channel of the cooling fluid at the region at which the insertion portion is disposed.

In the turbine blade of the present invention, it is preferable that the ends of the gap pin fins and the insertion portion be in contact.

With this structure, the cooling fluid flowing between the inner walls of the pin fin channel and the insertion portion flows between the gap pin fins. This increases the cooling performance (cooling efficiency) due to the pin fins as compared with a case in which the ends of the gap pin fins and the insertion portion are separated, so that part of the cooling fluid flows between the gap pin fins and the insertion portion.

A gas turbine of the present invention includes the turbine blade of the present invention.

Since the gas turbine of the present invention includes the turbine blade of the present invention, the cooling performance (cooling efficiency) of the turbine blade can be improved and a decrease in manufacturability can be prevented.

With the turbine blade and the gas turbine of the present invention, the insertion portion is disposed in the gap formed between the gap pin fins. Therefore, the cross-sectional area of the channel at the supply channel side of the pin fin channel, through which cooling fluid flows, decreases as compared with a case in which the insertion portion is not disposed, so that the velocity of the cooling fluid at the region at the supply channel side increases. This increases the cooling efficiency at the region at the supply channel side, which improves the cooling efficiency of the pin fin channel, thus improving the cooling performance (cooling efficiency) of the turbine blade.

DETAILED DESCRIPTION OF THE INVENTION

A gas turbine according to an embodiment of the present invention will be described with reference to FIGS. 1 to 7. In this embodiment, the turbine blade of the invention of the present application is described as applied to a first-stage vane and a second-stage vane of a turbine 4 of a gas turbine 1.

Figure 1:
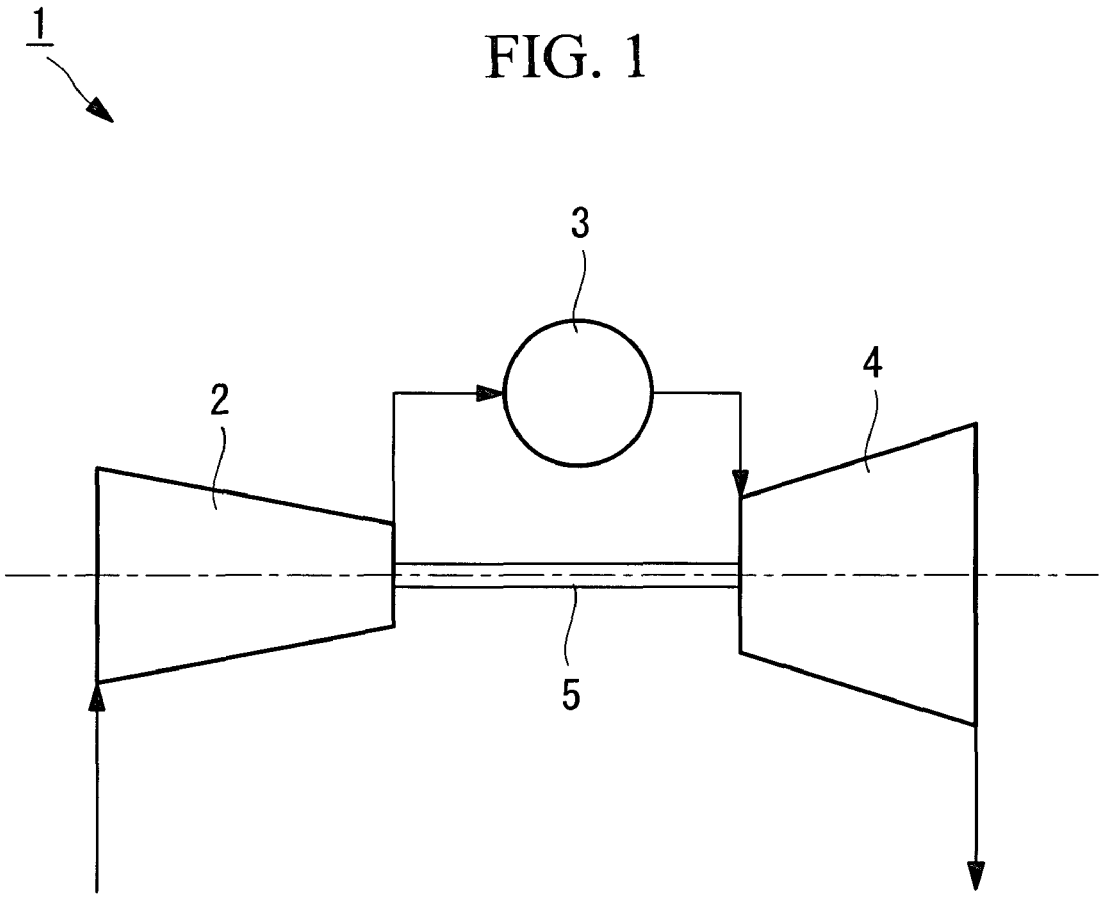
FIG. 1 is a schematic diagram illustrating the configuration of a gas turbine according to an embodiment of the present invention.

FIG. 1 is a schematic diagram illustrating the configuration of the gas turbine according to the embodiment.

The gas turbine 1 includes, as shown in FIG. 1, a compressor 2, a combustor 3, the turbine 4, and a rotary shaft 5.

As shown in FIG. 1, the compressor 2 takes in air, compresses it, and supplies the compressed air to the combustor 3. A rotational driving force is transmitted to the compressor 2 from the turbine 4 through the rotary shaft 5, so that the compressor 2 is rotationally driven, thereby taking in and compressing air.

The compressor 2 may be a known one and is not particularly limited.

As shown in FIG. 1, the combustor 3 mixes fuel supplied from the exterior with the supplied compressed air, burns the fuel-air mixture to generate high-temperature gas, and supplies the generated high-temperature gas to the turbine 4.

The combustor 3 may be a known one and is not particularly limited.

As shown in FIG. 1, the turbine 4 extracts a rotational driving force from the supplied high-temperature gas to rotationally drive the rotary shaft 5.

The turbine 4 has vanes (turbine blades) 10 mounted to the casing (not shown) of the gas turbine 1 and blades that are mounted to the rotary shaft 5 and rotate with the rotary shaft 5, which are arranged at regular intervals in the circumferential direction.

The vanes 10 and the blades are arranged alternately from the combustor 3 side in the downstream direction of the flow of the high-temperature gas in order of the vanes 10 and the blades. Paired vanes 10 and blades are called stages, which are numbered the first stage, the second stage, etc. from the combustor 3 side.

As shown in FIG. 1, the rotary shaft 5 transmits a rotational driving force from the turbine 4 to the compressor 2. The rotary shaft 5 is provided with the compressor 2 and the turbine 4.

The rotary shaft 5 may be a known one and is not particularly limited.

Here, the vanes 10 provided at the first stage and the second stage, which is a characteristic of the present invention, that is, a first-stage vane and a second-stage vane, will be described.

Figure 2:
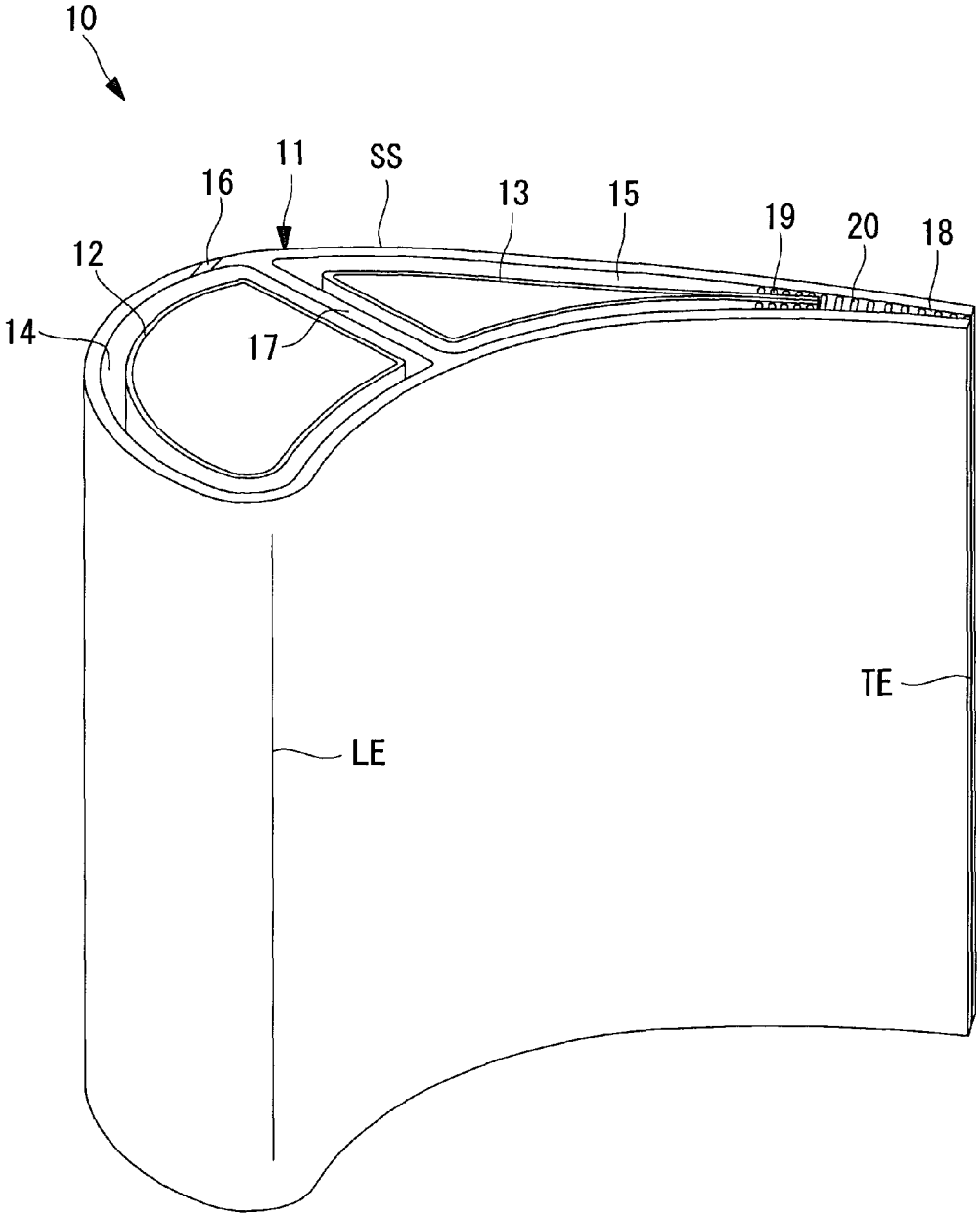
FIG. 2 is a perspective view illustrating the schematic structure of a vane which can be applied to a first-stage vane and a second-stage vane of a turbine 4 in FIG. 1.
Figure 3:
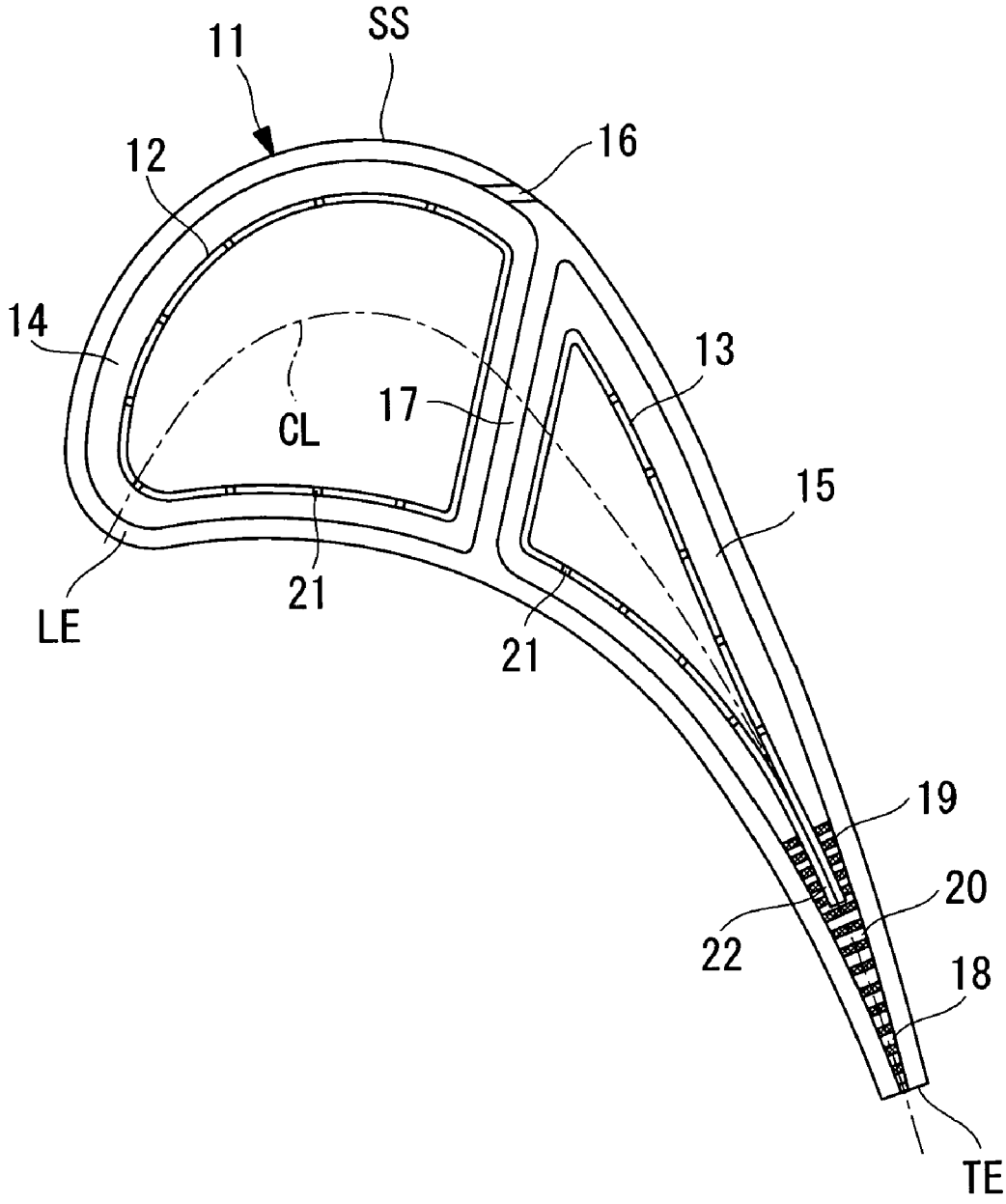
FIG. 3 is a cross-sectional view illustrating the schematic structure of the vane in FIG. 2.

FIG. 2 is a perspective view illustrating the schematic structure of the vane which can be applied to a first-stage vane and a second-stage vane of a turbine 4 in FIG. 1. FIG. 3 is a cross-sectional view illustrating the schematic structure of the vane in FIG. 2.

As shown in FIGS. 2 and 3, the vane 10 has an airfoil 11, a front insert 12, and a rear insert 13.

As shown in FIGS. 2 and 3, the airfoil 11 is formed in a blade shape in cross section and extends in the span direction (vertically in FIG. 2).

The airfoil 11 has a front cavity 14, which is a hollow formed at the leading edge LE and extending in the span direction, a rear cavity (supply channel) 15, which is a hollow formed at the trailing edge TE and extending in the span direction, and film cooling holes 16 communicating with the front cavity 14. In other words, the airfoil 11 has, in its interior, a hollow extending in the span direction, and a partition that partitions the hollow into the front cavity 14 and the rear cavity 15 is provided in the hollow.

The front cavity 14 and the rear cavity 15 are hollows through which cooling fluid supplied from the exterior to the vane 10 flows and constitute a structure related to impinging cooling for cooling the airfoil 11, together with the front insert 12 and the rear insert 13.

Compressed air extracted from the compressor 2 etc. is a possible example of the cooling fluid.

In the front cavity 14, the front insert 12 is disposed at a predetermined space from the inner wall of the front cavity 14. On the other hand, in the rear cavity 15, the rear insert 13 is disposed at a predetermined space from the inner wall of the rear cavity 15.

As shown in FIG. 3, the film cooling holes 16 are through-holes that connect the front cavity 14 and the exterior of the airfoil 11 and are provided at intervals in the span direction in a suction surface SS, which is a curved surface protruding in a convex shape, of the airfoil 11.

Furthermore, the film cooling holes 16 are formed from the front cavity 14 to the exterior as slanting holes inclined from the leading edge LE to the trailing edge TE.

Furthermore, the rear cavity 15 is provided with a pin fin channel 18, which is a hollow extending from the rear cavity 15 toward the trailing edge TE along the center line CL of the airfoil 11 and which is a region in which gap pin fins 19 and pin fins 20 are provided.

The pin fin channel 18 is a channel in the rear cavity 15, through which cooling fluid flows after being used for impinging cooling, and constitutes a structure related to pin fin cooling for cooling the vicinity of the trailing edge TE of the airfoil 11. The pin fin channel 18 is a channel extending from the rear cavity 15 to the trailing edge TE of the airfoil 11 and opens to the exterior at the trailing edge TE.

A shown in FIGS. 2 and 3, the pin fin channel 18 is provided with the gap pin fins 19 and the pin fins 20.

The gap pin fins 19 are a plurality of substantially columnar members protruding from regions at the rear cavity 15 side of the pin fin channel 18, the regions being a pair of inner walls constituting the pin fin channel 18. The amount of protrusion of the gap pin fins 19 from the above-described inner walls is set so as to form a gap between the gap pin fins 19 into which the end portion 22 of the rear insert 13 can be inserted.

The pin fins 20 are a plurality of substantially columnar members that connect regions at the trailing edge TE side of the pin fin channel 18, the regions being the pair of inner walls constituting the pin fin channel 18. The shape and arrangement of the pin fins 20 can be known ones and are not particularly limited.

The front insert 12 constitutes a structure related to impinging cooling for cooling the leading edge LE of the airfoil 11, together with the front cavity 14. The front insert 12 is a substantially cylindrical member having a cross-sectional form similar to the cross-sectional form of the front cavity 14. Furthermore, the front insert 12 has a plurality of discharge holes 21 through which the cooling fluid flowing therethrough spouts against the inner wall of the front cavity 14.

The rear insert 13 constitutes a structure related to impinging cooling, like the front insert 12, for cooling the trailing edge side of the airfoil 11. The rear insert 13 is a substantially cylindrical member having a cross-sectional form similar to the cross-sectional form of the rear cavity 15. Furthermore, the rear insert 13 has a plurality of discharge holes 21 through which the cooling fluid flowing therethrough spouts against the inner wall of the rear cavity 15.

Figure 4:
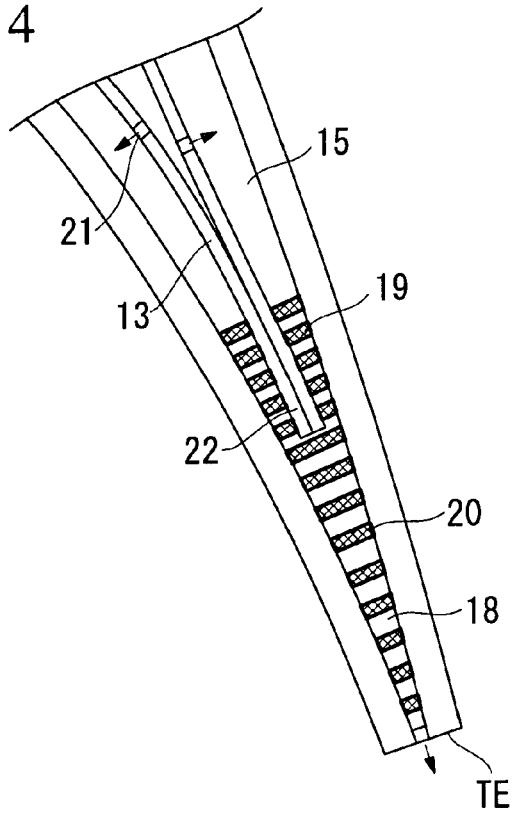
FIG. 4 is a schematic diagram illustrating the structure in the vicinity of a pin fin channel in FIG. 3.

FIG. 4 is a schematic diagram illustrating the structure in the vicinity of the pin fin channel in FIG. 3.

As shown in FIG. 4, the end portion (insertion portion) 22 of the rear insert 13 adjacent to the trailing edge TE is disposed in the gap formed between the gap pin fins 19, and the ends of at least part of the gap pin fins 19 and the end portion 22 of the rear insert 13 are in contact. In other words, it is desirable that the rear insert 13 and the ends of the gap pin fins 19 opposed to the rear insert 13 be in contact.

Furthermore, the end portion 22 is disposed so as to fill the gap between the gap pin fins 19. Accordingly, it is formed to have a predetermined length.

The maximum length of the end portion 22 to be inserted into the gap formed between the gap pin fins 19 is set to about half of the entire length of the pin fin channel 18.

The rear insert 13 is formed of a single plate member into a cylindrical shape, and the portion where both ends of the plate member contact is the end portion 22. The above-described contact portion is longer than the end portion 22 and extends not only to the gap between the gap pin fins 19 but also to the region of the rear cavity 15. Furthermore, the above-described contact portion, in particular, the end portion 22, is formed with the same thickness from the rear cavity 15 toward the trailing edge TE.

This allows the cooling fluid flowing between the inner walls of the pin fin channel 18 and the end portion 22 to flow between the gap pin fins 19. This increases the cooling performance (cooling efficiency) of the pin fin cooling as compared with a case in which the ends of the gap pin fins 19 and the end portion 22 are separated, so that part of the cooling fluid flows between the gap pin fins 19 and the end portion 22.

The end portion 22 of the rear insert 13 may be formed such that it decreases in cross-sectional area as it approaches to the trailing edge TE and is not particularly limited. In other words, the end portion 22 may be formed such that the cross-sectional area thereof decreases as the cross-sectional area of the pin fin channel 18 itself decreases from the rear insert 13 toward the trailing edge TE.

This can reduce changes in the cross-sectional area of the channel, through which the cooling fluid flows, in the region of the pin fin channel 18 adjacent to the rear cavity 15.

Figure 5:
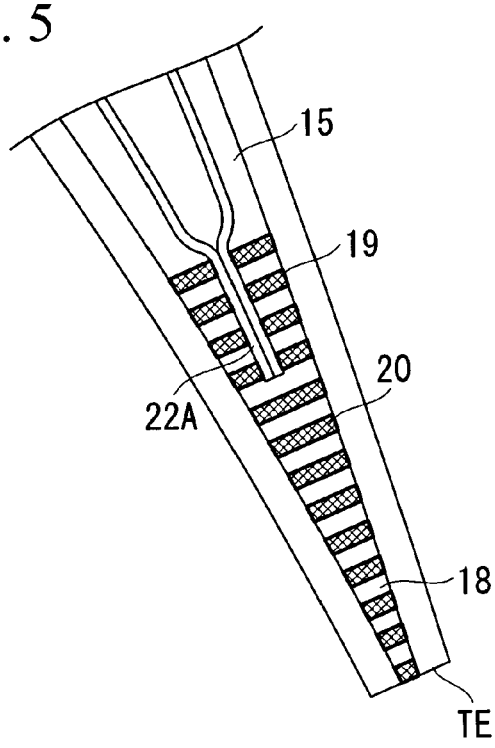
FIG. 5 is a schematic diagram illustrating another structure in the vicinity of the pin fin channel in FIG. 3.

FIG. 5 is a schematic diagram illustrating another structure in the vicinity of the pin fin channel in FIG. 3.

As shown in FIG. 4, the end portion 22 of the rear insert 13 adjacent to the trailing edge TE may have a structure in which the plate members of the rear insert 13 gradually approach each other from the rear cavity 15 toward the area between the gap pin fins 19 and come into close contact at the end portion 22, or alternatively, as shown in FIG. 5, may have a structure in which the plate members of the rear insert 13, which are separated in the rear cavity 15, gently approach each other at the portion where they enter between the gap pin fins 19, and come into close contact at the gap between the gap pin fins 19, in other words, at an end portion (insertion portion) 22A; there is no particular limitation.

On the other hand, the discharge holes 21 in the rear insert 13 are formed in the region of the rear cavity 15 in which the gap pin fins 19 are not provided, in other words, in the region of the rear cavity 15 other than the end portion 22. In other words, the end portion 22, facing the gap pin fins 19, of the rear insert 13 is not provided with the discharge holes 21.

Next, the flow of the cooling fluid in the vane 10 with the above structure will be described.

The cooling fluid that cools the vane 10 is supplied from the exterior of the vane 10 to the front cavity 14 and the rear cavity 15. For example, when compressed air extracted from the compressor 2 is used as the cooling fluid, the extracted compressed air is supplied from the hub (base) of the vane 10 to the interior of the front insert 12 in the front cavity 14 and to the interior of the rear insert 13 in the rear cavity 15.

The cooling fluid that is supplied into the front insert 12 and the rear insert 13 flows in the span direction and spouts against the inner walls of the front cavity 14 and the rear cavity 15 through the discharge holes 21.

The cooling fluid that has spouted through the discharge holes 21 collides with the inner walls of the front cavity 14 and the rear cavity 15 to cool the inner walls against which it collides and the airfoil 11 around them (impinging cooling).

The cooling fluid that has performed impinging cooling in the front cavity 14 flows in the space between the front cavity 14 and the front insert 12 and flows into the film cooling holes 16. The cooling fluid that has flowed into the film cooling holes 16 flows out through the suction surface SS of the airfoil 11 to the exterior, that is, into the high-temperature gas flowing through the turbine 4 to coat the downstream side of the suction surface SS from the film cooling holes 16 in the form of a film.

Coating the airfoil 11 in the form of a film with the cooling fluid in this way can reduce the flow of heat from the high-temperature gas flowing through the turbine 4 to the airfoil 11 (film cooling).

The cooling fluid that has performed impinging cooling in the rear cavity 15 flows in the space between the rear cavity 15 and the rear insert 13 and flows into the pin fin channel 18. The cooling fluid that has flowed into the pin fin channel 18 flows between the gap pin fins 19 and thereafter flows between the pin fins 20 to cool the trailing edge TE of the airfoil 11 and its periphery (pin fin cooling).

The cooling fluid that has performed pin fin cooling flows to the exterior, that is, into the high-temperature combustion gas flowing through the turbine 4 through the trailing edge TE side opening of the pin fin channel 18.

With the above-described structure, the end portion 22 is disposed in the gap formed between the gap pin fins 19. This decreases the cross-sectional area of the channel of the pin fin channel 18 adjacent to the rear cavity 15, through which the cooling fluid flows, as compared with a case in which the end portion 22 is not disposed, thereby increasing the velocity of the cooling fluid in the rear cavity 15 side region. This increases the cooling efficiency of the rear cavity 15 side region, which improves the cooling efficiency of the pin fin channel 18, thus improving the cooling performance (cooling efficiency) of the turbine blade.

Figure 6:
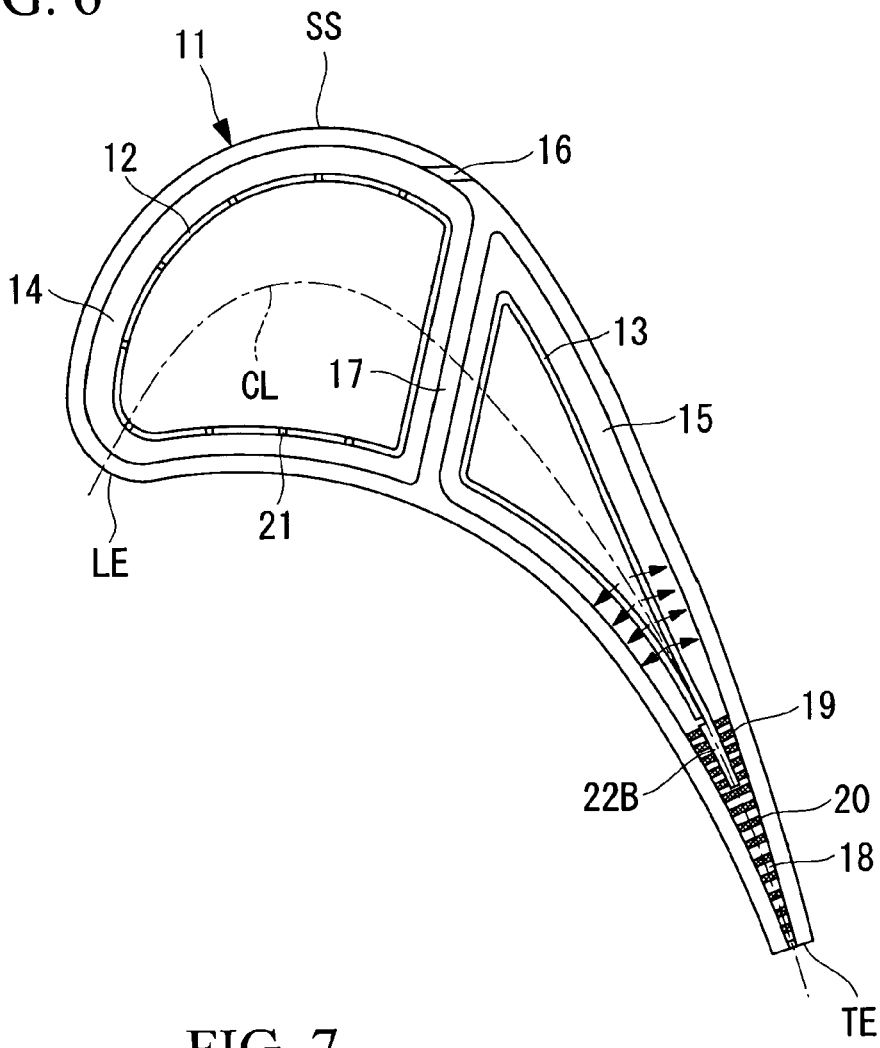
FIG. 6 is a cross-sectional view illustrating another schematic structure of the vane in FIG. 3.
Figure 7:
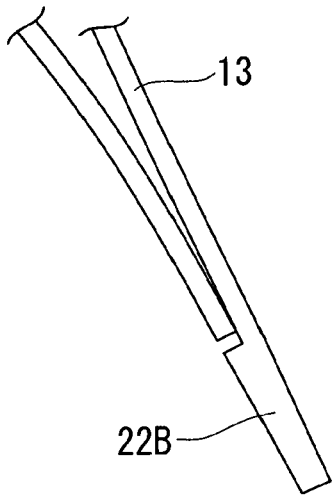
FIG. 7 is a partial enlarged view illustrating the structure of the end portion of a rear insert in FIG. 6.

FIG. 6 is a cross-sectional view illustrating another schematic structure of the vane in FIG. 3. FIG. 7 is a fragmentary enlarged view illustrating the structure of the end portion of the rear insert in FIG. 6.

As in the above-described embodiments, the ends of the plate member that constitute the rear insert 13 and the end portion 22 may be flush, as shown in FIG. 3, or alternatively, the ends of the plate member may be staggered, that is, only one plate member may form an end portion 22B, as shown in FIGS. 6 and 7; there is no particular limitation.

Specifically, as shown in FIGS. 6 and 7, regarding one plate member extending toward the trailing edge TE, the thickness of the portion extending more than the other plate member is larger than the thickness of the other portion. The thick portion decreases in thickness toward the trailing edge TE.

This structure allows the cross-sectional area of the channel at the inlet of the pin fin region through which the cooling fluid flows to be made substantially constant.

The technical scope of the present invention is not limited to the above-described embodiments; various modifications can be made without departing from the spirit of the present invention.

For example, in the above-described embodiments, the turbine blade of the present invention is described as applied to the first and second vanes 10 of the turbine 4; however, it is not limited to the vanes 10 and may be used for blades, without particular limitation.

What is claimed is:

1. A turbine blade comprising:

an airfoil;

a supply channel extending through the interior of the airfoil in the span direction, through which cooling fluid flows;

a pin fin channel extending from the supply channel along the center line of the airfoil toward the trailing edge of the airfoil and opening at the trailing edge to the exterior of the airfoil;

a plurality of gap pin fins projecting from a pair of opposing inner walls that constitute the pin fin channel at a region at the supply channel side of, the pin fin channel and forming a gap between ends of the gap pin fins such that the ends are not in contact with each other, said gap extending in the span direction;

pin fins connecting the pair of opposing inner walls at a region at the trailing edge side of the pin fin channel; and an insertion portion disposed in the gap to decrease the area of the channel of the cooling fluid at the region at the supply channel side of the pin fin channel.

2. The turbine blade according to claim 1, wherein the cross-sectional area of the insertion portion decreases from the supply channel toward the trailing edge.

3. The turbine blade according to claim 1, wherein the ends of the gap pin fins and the insertion portion are in contact.

4. A gas turbine comprising the turbine blade according to claim 1.

* * * * *